US005950944A

United States Patent [19]

Larsen

[11] Patent Number: 5,950,944

[45] Date of Patent: Sep. 14, 1999

[54] LAMINAR MILL LINER

[76] Inventor: Darrell R. Larsen, 119 N. 300 East, Rexburg, Id. 83440

[21] Appl. No.: 09/135,621

[22] Filed: Aug. 18, 1998

[51] Int. Cl.[6] ..... B02C 17/22

[52] U.S. Cl. ..... 241/183; 241/299; 241/300

[58] Field of Search ..... 241/182, 183, 241/299, 300, 284, 197

[56] References Cited

U.S. PATENT DOCUMENTS

| | | | |
|---|---|---|---|
| 2,994,486 | 8/1961 | Trudeau | 241/197 |
| 3,272,445 | 9/1966 | Weller | 241/197 |
| 3,503,562 | 3/1970 | Haberman | 241/197 |
| 4,052,014 | 10/1977 | Jonsson | 241/183 |
| 4,319,719 | 3/1982 | Larsen | 241/183 |
| 4,946,110 | 8/1990 | Harris et al. | 241/182 |

FOREIGN PATENT DOCUMENTS

| | | | |
|---|---|---|---|
| 432024 | 7/1926 | Germany | 241/197 |
| 1304872 | 4/1987 | U.S.S.R. | 241/183 |

*Primary Examiner*—Mark Rosenbaum
*Attorney, Agent, or Firm*—Morriss Bateman O'Bryant & Compagni

[57] ABSTRACT

A novel laminar assembly for use with comminution equipment, such as a liner for protecting the shell of an ore crushing mill or as a wear tip on a blow bar for use in a rock impact crusher. The laminar segment includes a plurality of laminae which are attached to each other with a pair of rods extending through a pair of axial holes positioned in the base of the laminae, thereby forming a segment of virtually any desired length. Conventional mounting bolts may extend through radial holes in the laminae between the axial holes to attach the liner segment to the comminution equipment. The utilization of small laminae enable the laminae to be formed from hardened materials such as heat treated steel or cut from a plate and then heat treated such that the microstructure throughout the laminae may be strictly controlled, thereby providing a laminae with consistent hardness and toughness throughout the laminae.

29 Claims, 6 Drawing Sheets

LAMINAR MILL LINER

BACKGROUND OF THE INVENTION

1. The Field of the Invention.

The present invention relates generally to methods and apparatus for providing a protective lining and impacting surface for equipment used in ore and rock comminution. More particularly, the present invention relates to a new and improved liner assembly for providing the shell of an ore grinding mill with a liner providing substantially the same hardness and toughness throughout the liner in which the amount of usable liner is maximized.

2. The Background Art.

In commercial mining operations, large autogenous and semi-autogenous mills are often employed to comminute ore removed from the mine. Such mills include a large drum, having a typical diameter of 28 feet and a length of 12 feet. In operation, ore is fed through a trunnion into the feed end of the drum while the drum is being rotated about a central axis. As the drum rotates, the ore is comminuted by being subjected to both continuous-pressure and impact mechanisms. The ore is then removed from the opposite, or discharge end of the mill.

These autogenous and semi-autogenous mills are typically intended for continuous operation. However, because ores being comminuted in the mill may be hard and highly abrasive, the drum will quickly wear out unless some provision is made to protect the drum from wear while the mill is in operation. Replacing the drum not only would cause a serious disruption in the operation of the mill, but would result in such a significant expense that the use of such a mill would be impractical.

The universally accepted solution for protecting the drum from wear is to employ a liner which may be mounted onto the cylindrical sections of the drum, or the "shell" of the mill. In recognition of this necessity to include a liner, when the drums are manufactured, a series of rows of mounting holes are drilled into the shell of the mill. A series of liner segments (commonly referred to as lifter bars) may then be mounted onto the shell of the mill utilizing these mounting holes, thereby virtually completely covering the shell of the mill. These mounting holes are typically spaced in the axial direction (i.e., along the axis of rotation of the mill) approximately 12 to 24 inches apart.

After a period of use, the liner segments are worn to the point that they must be replaced. In order to reduce to a minimum the amount of down time of the mill associated with the replacement of liner, liner design has been directed towards facilitating rapid replacement of the liner.

It takes virtually the same amount of time to replace a large liner segment as it takes to replace a small liner segment. Thus, the trend in liner design has been to make liner segments as large as possible, resulting in fewer liner segments to replace. For example, by doubling the size of the liner segments, the number of liner segments which must be replaced is reduced by half. This results in a corresponding reduction in time required to replace the liner. Making larger liner segments, however, introduces heat treating problems which result in non-uniform hardness and toughness of the liner and thus a liner in which the overall hardness and toughness are substantially less than would typically be possible with smaller liner segments.

Because of the weight of the liner segments, special equipment is employed to lift the segments and place them in position for mounting to the shell of the mill. This "liner handler" is always used to support the liner segments during mounting. Thus, the increased weight associated with employing larger liner segments results in a negligible increase in the difficulty of replacing the liner.

In addition to being advantageous to mill operators in the amount of down time of the mill during replacement, large liners also represent a significant economic advantage over smaller liners to liner manufacturers. A significant factor in determining the price which is charged for such liners is their weight. Liners are usually priced by charging a predetermined amount per pound of material.

Because such liners are made by casting, a liner manufacturer may double the poundage of sellable material produced in one mold simply by doubling the size of the liner. It is not uncommon to produce a liner with one casting which results in several thousand pounds of material which is ready to sell. As is the case when installing the liner, casting a larger liner does not result in a marked increase in the amount of work involved. Thus, when producing liners having half the size, twice as much work is involved by the manufacturer to produce the same dollar volume of product.

Because of the enormous size and weight of most ore grinding mills, the size limit of steel plate which is available, the capacity of metal forging machines, and the transportation limitations which arise when dealing with such machinery, it is necessary to manufacture the mills in several sections which may be assembled at the mill site. The mills are typically made of cylindrical quadrants having flanges extending from their perimeter for mounting to one another. By representative example, when constructing the mill, the cylindrical quadrants are mounted lengthwise to each other to form a cylinder. Several cylinders may be mounted to each other to achieve the desired length of mill. End pieces may then be mounted to the ends of the cylinder to enclose the mill.

The joints along the circumference of the drum represent the weakest structural points in the drum. To compensate for this weakness, liners mounted inside the drum may be mounted such that they span these joints and are secured to the drum on both sides of the joints. Such a liner, therefore, serves a dual purpose; it provides a hard material used in comminuting the ore and it reinforces the structure of the drum, thereby lending stability to the mill.

From the foregoing, it can be seen that significant economic forces have dictated that the size of liners employed to protect the shell of the mill be as large as possible. Additionally, the use of large liners has been preferred because their size enables the liners to be used to reinforce the joints of the cylindrical quadrants which are mounted together to form the mill.

Replaceable impact surfaces found in other comminution equipment also tend to be large for many of the same reasons as described above. For example, the blow bar used in a rock impact crusher is preferably made of one piece, thereby keeping to a minimum the time involved to replace the blow bar. Additionally, manufacturing of the blow bar is facilitated if only one casting must be performed to produce the blow bar.

The use of large impact surfaces, however, does present various difficulties. For example, mill shell liners are preferably made of a material which is highly abrasion resistant in order to withstand virtually continuous contact with hard and highly abrasive ores. Additionally, the liner must be impact resistant so that it does not rapidly disintegrate due to brittle failure during operation of the mill.

Because the liner must have a high hardness, it is not feasible to machine the large liner segments. Use of a material which would be machinable with conventional equipment would necessarily require use of a material which would not have sufficient hardness for use as a liner. Thus, manufacturing liner segments of a castable material has been the only economically viable method of manufacture.

Although the properties of hardness and toughness are, to a large extent, exclusive of each other, a suitable combination of hardness and toughness may be obtained by heat treating the liner. An example of a material ideally suited for this application would be martensitic white iron or martensitic steel. The primary difficulty which arises when attempting to quench a large casting to form a martensitic microstructure throughout the liner segment is that because of the thickness of the liner the rate of heat loss may not be sufficient to avoid transformation to another microstructure. This frequently results in the formation of a martensitic microstructure at the surface of the casting with other, softer microstructures being formed at the core. Additionally, the slower rate of solidification associated with the larger casting will produce a product having a larger grain size than that of a smaller casting, thereby adversely affecting the hardness of the final product.

Thus, one of the primary disadvantages associated with the production of martensitic liner segments is that it is impossible to obtain the same degree of hardness in the core of the liner segment as at the surface. In operation, once the hard surface of the liner becomes worn, the remainder of the liner, which does not enjoy the same degree of hardness as the surface, will quickly wear. This obviously decreases the operational time of the mill between replacement of liners.

Another means employed by the prior art to achieve a liner assembly having a hard surface is to use a composite liner assembly. A composite liner is a liner assembly which employs a tough material for the primary structure of the liner coupled with one or more inserts or segments formed from a highly abrasion-resistant material which comprises a secondary structure. The tough primary structure is attached to the hard secondary structure in such a manner that the hard inserts or segments are exposed directly to the ore fragments.

Composite liner assemblies are designed primarily for use in rod mills where there is no point contact. In ball mills and autogenous mills where there is a substantial amount of point contact with the liners, composite liners are not effective because the hard inserts only cover approximately 30 percent of the surface area of the shell of the mill. Another disadvantage to such composite liner assemblies is that they are geometrically complex and utilize complicated mounting mechanisms. Thus, composite liner assemblies are frequently expensive to manufacture and, because of their many parts, are difficult to install. Additionally, when the hard secondary material eventually breaks away due to its brittleness, the hard inserts or segments must immediately be replaced before the primary structure is irreparably damaged by the abrasive action of the ore. Because the primary structure serves no purpose other than as a mounting mechanism for the hard secondary structure, it adds weight to the already heavy mill without providing a corresponding increase in crushing efficiency.

One attempt in the art to overcome the foregoing disadvantages of other mill liners is provided in U.S. Pat. No. 4,946,110, issued Aug. 7, 1990, to Harris et al. which is hereby incorporated by this reference. Harris et al. discloses a laminar segment having a plurality of laminae which are attached to each other with a rod extending through holes positioned in the base of the laminae to form a segment of virtually any length. Mounting bolts are provided with a hole that extends through the head of the mounting bolt for mounting the rod, and thus the segment, by passing the rod through the hole in the head of the mounting bolt. The mounting bolt secures the segments to the mounting surface of the comminution equipment by extending through holes in the mounting surface. Despite the purported advantages presented in the Harris et al. reference, several disadvantages exist, the most important of which is the fact that the system of bolts and segments often cause the segments to prematurely fail when in use. In addition, Harris et al. includes a complicated system for combining the laminae together and attaching the segment to the equipment. Moreover, complex custom bolts with specially shaped heads must be employed to mate with the laminae and to receive the rod. Another disadvantage with the laminar segment is the complex configuration of the individual lamina which maintain the segment in alignment, or prevent relative movement of the laminate. Keying features such as tabs and recesses must be cast into each lamina to mate with similar tabs and recesses in adjacent lamina. Yet another disadvantage of the Harris et al. disclosure is that the use of a single rod results in a relatively thinner wear portion of the liner segment.

It will be appreciated, therefore, that what is needed in the art are methods and apparatus for covering the shell of an ore grinding mill with a liner which may be easily and inexpensively installed and replaced.

It would be a further enhancement in the art if such liners could be manufactured such that the microstructure of the liner could be controlled during heat treatment, thereby producing a liner having the same microstructure throughout (such as a martensitic microstructure) and substantially the same grain size throughout.

Indeed, it would be yet a further advancement in the art if such a liner could be heat treated during the manufacturing process such that the risks of breaking the liner and establishing significant residual stresses within the liner are substantially eliminated.

It would also be an advancement in the art if such a liner could be manufactured without employing significant amounts of expensive alloys.

It would also be an advancement in the art if such a liner could be manufactured without complicated systems for combining the laminae together into a segment.

It would also be an advancement in the art if such a liner could be manufactured without complicated systems for attaching the segment to the shell of the comminution equipment.

It would also be an advancement in the art if such a liner could be manufactured without complicated systems for preventing relative movement of the laminae.

It would also be an advancement in the art if such a liner could be manufactured without complex configurations for the laminae.

OBJECTS AND SUMMARY OF THE INVENTION

It is therefore an object of the present invention to provide a method and apparatus for covering a shell of an ore grinding mill with a liner that may be easily and inexpensively installed and replaced.

It is another object of the present invention to provide such a liner that can be relatively easily manufactured by cutting or milling the liner from a steel sheet or plate.

It is yet another object of the present invention to provide such a liner with a simple system of attaching the liner to the shell.

It is another object of the present invention to provide such a liner with a simple system for combining individual lamina into an integral segment and prevent relative movement of the laminae.

It is another object of the present invention to provide such a liner of individual lamina combined into an integral segment with simple configurations for the laminae.

It is still another object of the present invention to provide lamina that can be manufactured by methods other than casting, such as cutting from a steel sheet or milling.

It is yet another object of the present invention to provide lamina that maximize the life of each segment.

The above objects and others not specifically recited are realized in a number of specific illustrative embodiments of a laminar segment for use as an impact surface in comminution equipment such as the liner of an ore crushing mill. The laminar segment has a plurality of laminae associated together to form an integral segment. Each lamina has a base section and a wear section and generally planer parallel opposite sides configured for abutting sides of adjacent lamina with the base portion configured for being abutted against the comminution equipment. The base section is attached to the liner of the comminution equipment while the wear section contacts the ore or other material to be crushed. The laminar or liner segment includes combining means for combining the plurality of laminae to form an integral segment. In addition, the combining means includes alignment means for preventing relative movement of the laminae. In accordance with one aspect of the present invention, a pair of rods advantageously extend through the pair of holes to combine the laminae together and align the laminae.

The laminar or liner segment also has attachment means for attaching the integral segment to the liner of the comminution equipment. In accordance with one aspect of the present invention, standard liner bolts extend radially through radial holes in the laminae between the axial holes to attach the segment to the liner. In accordance with one aspect of the present invention, each lamina advantageously has a pair of spaced apart bores or holes extending through the base section in an axial direction. A plurality of elongate members such as rods or the like are provided for extending through each of the laminae proximate the base portion for combining the laminae into an integral segment. Each rod may be associated with one or more internally threaded nuts with each of the nuts threaded onto the end of the rods for securing the elongate rods relative to the laminae such that the rods align the laminae in an abutting relationship Moreover, the elongate members align the plurality of laminae relative to each other. A means for securing the liner segment to the comminution equipment is also provided. Preferably, the elongate members and means for securing the liner segments to the comminution equipment operate independently.

The laminae of the present invention preferably comprise end plates, standard plates, hold down plates, and lifter plates. The standard plates are preferably thinner in an axial direction than the end plates, hold down plates and/or lifter plates. In addition, the standard plates may have different thicknesses in an axial direction to accommodate various comminution equipment which may have various liner bolt configurations.

The end plates define a pair of axial bores extending through the end plate and include recesses formed proximate each of the pair of axial bores for providing a nut relief. The elongate members extend through the axial bores.

Once assembled, the liner segments are secured to the comminution equipment with hold down bolts or other attachment devices. Preferably, the liner segments include one or more hold down plates each of which define a radially extending bore that extends through the hold down plate from the base portion to the wear portion. The bore is preferably configured for receiving a conventional liner bolt therein for securing said hold down plates to the comminution equipment.

In addition, the liner segments may include one or more lifter plates, each defining one or more lugs or lifting portions that are preferably integrally formed therewith for providing a means for lifting and maneuvering the assembled integral segment. Moreover, it may be desirable to provide one or more bolt protector plates having a wear portion that is substantially the same as the wear portion of an associated hold down plate. The bolt protector plates help to protect the hold down plate from becoming damaged during the milling process. Such bolt protector plates and hold down plates may have a wear portion that is substantially wider in the transverse direction than the wear portion of standard plates.

In a preferred embodiment, the wear portion of at least some of the laminae is offset in a transverse direction relative to the base portion.

It is preferred that each of the laminae are comprised of steel, iron, or alloys thereof. Moreover, it is preferable that the laminae be formed from steel plate material having a core and a surface. Such laminae are preferably heat treated for hardness prior to forming, such as the microstructure of the core is substantially equivalent to the surface microstructure.

In another preferred embodiment, at least some of the laminae are comprised of hardened rubber or another non-metallic materials that are substantially less expensive than the metal laminae. Such non-metallic laminae are interposed between at least some of the metal laminae to decrease the weight of each liner segment and substantially reduce the cost of each liner segment.

The present invention also comprises a method of forming liner segments for lining the surface of a grinding mill. The method comprises the steps of providing a sheet or plate of material suitable for forming a liner, such as steel, iron, or alloys thereof, forming a lamina from the sheet of material, and heat treating the lamina to produce a substantially consistent martensitic microstructure throughout the laminae.

In a preferred embodiment, the method further includes forming the laminae by milling or cutting. In addition, the laminae are each formed with a pair of axially extending bores through the base portion of each of the laminae for receiving a pair of rods therethrough. Some of the laminae are provided with a radially extending bore for receiving a liner bolt. Furthermore, some of the laminae are formed with one or more lugs therein configured for lifting the laminae.

To assemble the laminae into an elongate liner segment, a pair of elongate rods are provided for inserting through the axially extending bores and for stacking a plurality of laminae onto the elongate rods such that the plurality of laminae are substantially aligned relative to each other. The elongate rods are secured relative to the plurality of laminae to form an elongate liner segment. The assembled liner segment can then be lifted and secured relative to a surface of a grinding mill.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
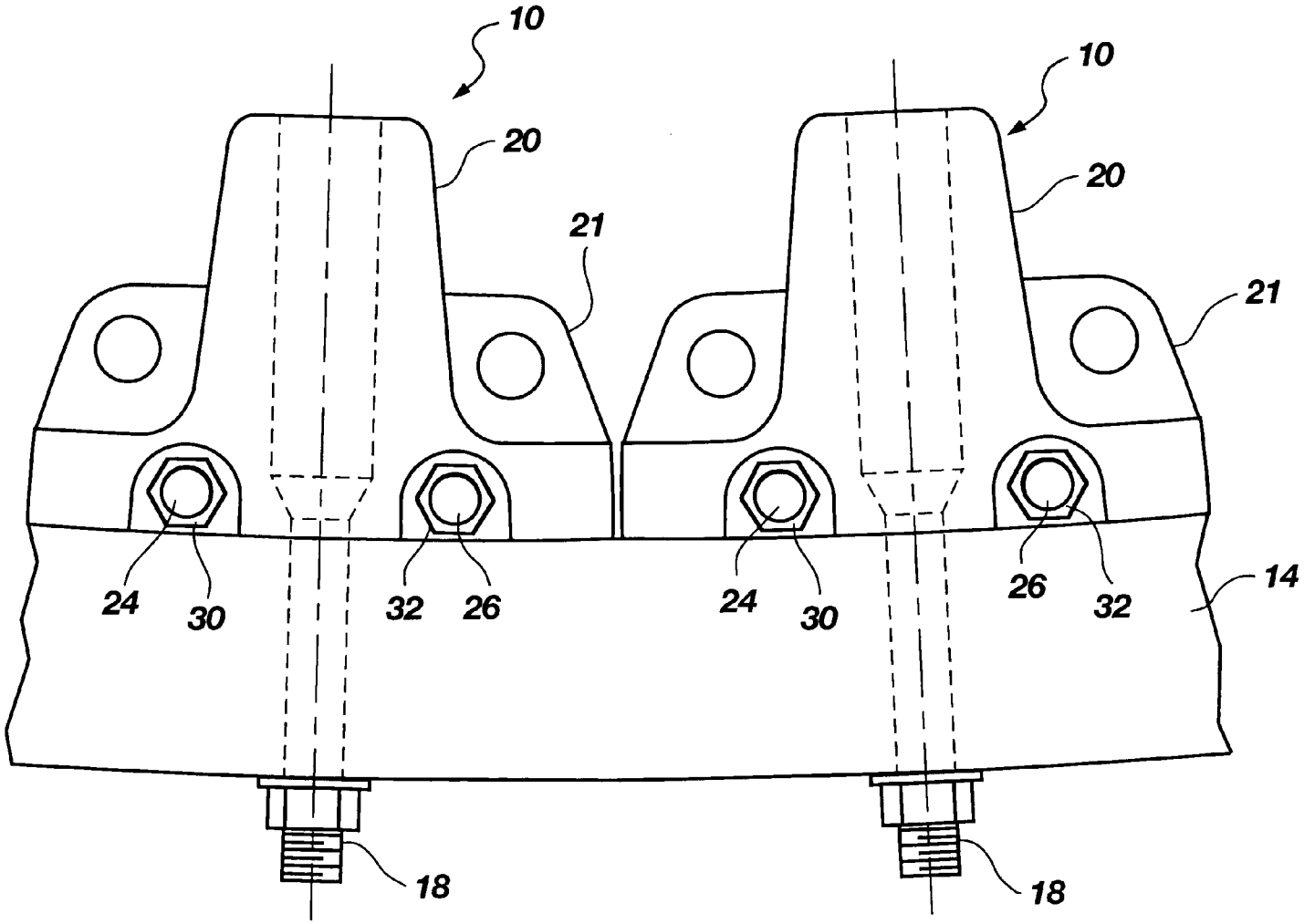
FIG. 1 is side view of a first preferred embodiment of a plurality of stacked lamina in accordance with the principles of the present invention installed on a shell of an ore crushing mill.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The present invention is directed to methods and apparatuses for lining a shell of an ore grinding mill, providing a wear tip of a blow bar, or for providing wear, lining, and/or grinding surfaces of other comminution equipment. Referring to FIG. 1, liner segments, generally indicated at 10, according to the present invention are illustrated installed on a shell 14 of an ore grinding mill (not shown). The shell 14 is generally of cylindrical shape having a center line about which the mill rotates. The liner segments 10 are coupled to the shell 14 with liner bolts 18. Each segment 10 is comprised of a plurality of laminae, two types of which namely laminae 20 and 21 are visible in FIG. 1, that are interconnected to form the integral segments 10.

When mounted in an ore grinding mill, the liner segments 10 are typically mounted on the shell 14 of the mill in the "axial" direction substantially parallel to the axis of rotation of the mill. Thus, as used herein, the "axial" direction refers to a direction substantially parallel to the axis of rotation of the mill, or parallel to the center line of the shell 14. It will be appreciated by one skilled in the art that the apparatus and methods of the present invention may also be used to provide liners configured for mounting along the walls of the feed cone and the discharge cone, as well as other areas in the mill in which liners are employed. Although such liners are not always mounted parallel to the axis of rotation of the mill, "axial direction," as used herein, shall refer to the direction of the length of the liner segments 10. When mounted on the shell 14 of the mill, the liner bolts 18 are directed in the "radial" direction—the direction extending outwardly from the axis of rotation of the mill in a plane substantially perpendicular to that axis. Accordingly, the "radial direction," as used herein, refers to a direction that is substantially parallel to the center line of the liner bolts 18. Finally, as used herein, the "transverse" direction refers to the direction substantially parallel to a line tangent to the mill at a right angle to the axis of rotation of the mill.

Each of the laminae 20 and 21 are interconnected or mounted relative to each other with a pair of elongate members or rods 24 and 26 which extend through holes (not visible in FIG. 1) in each of the laminae 20 and 21. The holes are positioned in each of the lamina 20 and 21 such that the laminae 20 and 21 are properly aligned relative to each other when assembled into an elongate segment 10. Preferably, each rod 24 and 26 includes externally threaded ends so that the rods 24 and 26 in combination with internally threaded fasteners 30 and 32, respectively, can be employed to hold the laminae 20 and 21 relative to each other. Accordingly, the pair of rods 24 and 26, or first and second rods, advantageously are disposed in a pair of axially aligned holes, the rods 24 and 26 extending through the axial holes laminae 20 and 21 to combine the laminae 20 and 21 together to form the integral liner segment 10. As will be described in more detail, the rods 24 and 26 preferably extend substantially the entire length of the segments 10. Moreover, the rods 24 and 26 may be threaded on both ends to receive nuts 30 and 32 to hold the lamina 20 on the rods 24 and 26. Alternatively, one end of the rods 24 and 26 may have a head formed thereon while the other end is threaded to receive a nut.

The rod and nuts are one example of a combining means for combining or otherwise holding the lamina in an abutted relationship and aligning the lamina relative to each other without the need for keying features such as various mating surfaces. Of course, those skilled in the art after reviewing the present disclosure will appreciate that other means within the scope of the present invention may be employed for combining the laminae, including for example, elongated bolts, rods with pins in the end, and other elongate fastening devices known in the art.

Figure 2:
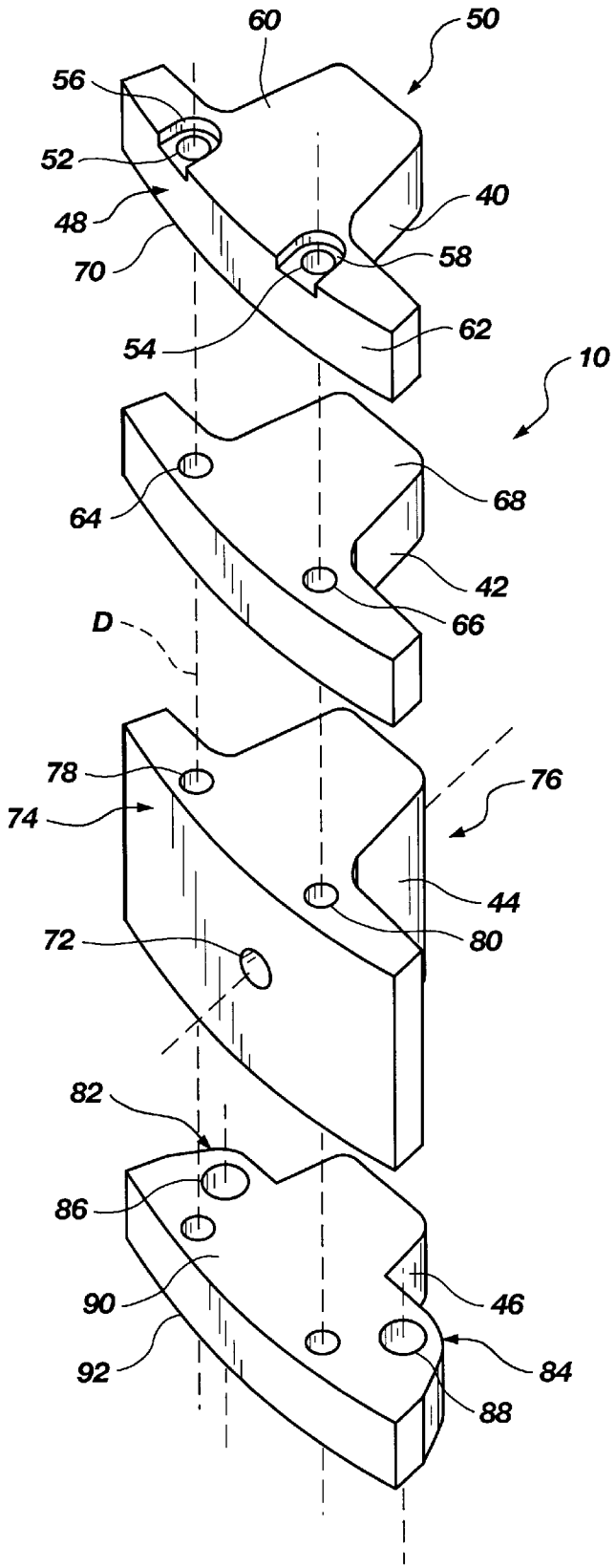
FIG. 2 is a perspective view of variously configured laminae in accordance with the principles of the present invention illustrating relative axial alignment of the laminar segments.

As indicated above, the laminae 20 and 21 are axially associated together to form the elongated integral segment 10. The present invention, however, provides a plurality of different types of laminae. As illustrated in FIG. 2, the laminae of the present invention are essentially stacked or otherwise abutted against each other to form a laminar segment 10. In this embodiment, four different laminae are shown including an end plate 40, standard plate 42, a hold down casting plate 44, and a lift plate 46. While each lamina or plate has special features for providing a specific function, each plate also includes some common features. The end plate 40 generally comprises a base section or portion, generally indicated at 48, and a wear section or portion, generally indicated at 50. The base portion is provided with a pair of holes or bores 52 and 54 that extend in an axial direction through the end plate 40. The rods 24 and 26 extend through the bores 52 and 54 and through the bores in the other lamina as indicated by dashed lines. Counterbores or recesses 56 and 58 are provided in the top surface 60 of the plate 40 adjacent the openings of the bores 52 and 54. The recesses have a depth such that the heads of the rods 24 and 26 and the fasteners 30 and 32 (see FIG. 1) do not substantially protrude, if at all, above the surface 60 so that the segment 10 may abut a surface. The base portion 48 preferably includes a curved surface 62 configured to substantially match the inside radius of the shell 14 (see FIG. 1). The base portion 48 is relatively wide compared to the width of the wear portion 50 so as to provide adequate support for the wear portion 50 which will be subject to high impact forces during the milling process.

Standard plate 42 has a general configuration that is substantially similar to the configurational shape of the end plate 42. The standard plate 42, however, does not include recesses proximate its axial bores 64 and 66 and thus defines a relatively flat surface 68 for abutting with the bottom surface 70 of the end plate 40. The bores 64 and 66 are positioned to substantially align with the bores 52 and 54 of the end plate 40. The length of the standard plate 42 measured relative to the dashed line D may be of a smaller length than that of the end plate or other lamina, such as those shown in FIG. 2. In addition, the standard plates 42 may be provided in different lengths to accommodate differently sized mill liners. In any event, while only illustrating one, there will typically be a number of standard plates 42 between the end plate 40 and the hold down casting or plate 44. The hold down plate 44 is generally of larger length than the other lamina in order to provide sufficient strength for holding a number of laminae relative thereto. The hold down plate 44 is provided with a radially extending bore 72 which extends from the base portion, generally indicated at 74 through the plate 44 to the wear portion, generally indicated at 76. It is also contemplated that the hold down plate 44 may define a radially extending bore that only extends a partial distance into the hold down plate 44. Such a bore may include internal threads into which an externally threaded bolt could be threaded to secure the hold down plate to the comminution equipment. While the hold down plate 44 has a length that may be larger than the standard plate 42 or the end plate 40, depending on the desired lengths of the standard or end plates 42 and 40, respectively, its overall configuration is substantially similar to the other lamina illustrated in FIG. 2. In addition, the hold down plate 44 is provided with a pair of axially extending bores 78 and 80 which are provided to both align the hold down plate 44 relative to the other lamina and provide a means for securing the hold down plate 44 to the other lamina.

Another type of lamina shown in FIG. 2 is the lift plate 46. The lift plate 46 provides a means for lifting and moving the laminar segment 10 once assembled relative to the shell 14 (see FIG. 1) for attachment thereto. Accordingly, it is preferable to assemble the entire laminar segment 10 including the laminae and elongate rods and then securing the segments to the shell 14 with liner bolts, such as liner bolts 18 (see FIG. 1). The lift plate 46 includes one or more lifting portions, generally indicated at 82 and 84, that provide a means for holding or gripping and moving the liner segment 10 once assembled. The lugs or lifting portions 82 and 84 in this embodiment are comprised of a pair of axially extending apertures or bores 86 and 88, respectively, that extend through the plate 46 from a top surface 90 to a bottom surface 92. Accordingly, various rods, pins, or other devices can be secured relative to the lifting portions 82 and 84 for lifting and maneuvering the liner segment 10.

As illustrated in FIG. 2, each plate 40, 42, 44, and 46 includes a pair of bores extending therethrough for securing the plates 40, 42, 44, and 46 relative to one another. By providing each plate 40, 42, 44, and 46 with axial holes or bores having a diameter, or cross section sized and configured for insertion of rods, such as rods 24 and 26 (shown in FIG. 1), two holes and two rods are used instead of one to secure the plates relative to each other. By employing a plurality of such bores and rods, the height (in the radial direction) of the base may be minimized. For example, a single 2 inch diameter rod may have been required to hold together a prior art segment. In the present invention, however, two 1.5 inch diameter rods may be used to replace the single rod, reducing the necessary height of the base section, increasing the height of the wear section, and thus prolonging the useful life of each lamina 20. In addition, the axial holes are preferably located close to the bottom surface of the lamina to maximize the amount of wearable material of the wear portion.

Because the wear section 50 defines the useful life of the lamina 20, the lamina 20 is preferably designed so that the wear section 50 is as large, or as high (radial direction), as possible with respect to the overall height (radial direction) of the lamina 20. For example, if the liner segment 10 is required to be 13 inches heigh (radial direction), then it is desirable that the wear section 50 comprise as much of the 13 inches as possible so that the useful life of the segment be as long as possible. Not only is the life of the lamina increased, but the material of the lamina is more efficiently used.

In addition, the pair of rods 24 and 26 disposed in the various pairs of axial holes, such as bores 52 and 54 advantageously align the plates 40, 42, 44, and 46 and thus prevent relative movement of the laminae. Thus, the rods 24 and 26 and holes 52 and 54 accomplish the dual purpose of combining the laminae together and aligning the laminae relative to each other. The use of multiple rods further negates the need for keying features such as mating surfaces taught by the prior art to align the laminae. Such details created complex configurations and complex castings. The laminae of the present invention require no such keying features and may therefore be formed from relatively thin steel sheet stock, as by cutting, milling or otherwise forming as is known in the art. Furthermore, because the laminae of the present invention may be formed from hardened materials, such as heat treated steel, the laminae do not have to be heat treated after formation to maintain uniform hardness and toughness.

Furthermore, by employing the pair of rods 24 and 26 shown in FIG. 1 to be disposed in the pair of axial holes, such as axial holes 52 and 54, the present invention advantageously allows for standard liner bolts 18 to be used to attach the segments 10 to the liner 14, as shown in FIG. 1. Prior art segments required complex liner bolts with holes formed in their heads through which the rods passed. Because the axial holes of each plate 40, 42, 44, and 46, and thus the rods 24 and 26, are spaced apart, the liner bolts 18 may be inserted through the hold down plates 44 between the rods 24 and 26. Accordingly, conventional liner bolts 18 may be utilized with the present invention and it is thus unnecessary to provide special liner bolts that must be linked to rods for combining the laminae.

While two such bores in each plate are shown in the preferred embodiments, it is also contemplated that a plurality of such bores could be provided in the respective base portions of the plates to further assist in aligning the plates relative to each other. Moreover, by employing a plurality of bores and a corresponding plurality of rods, the bores and holes could be made with even a smaller diameter to provide sufficient strength for holding the lamina in place while maximizing the amount of wearable material of each lamina.

Figure 3A:
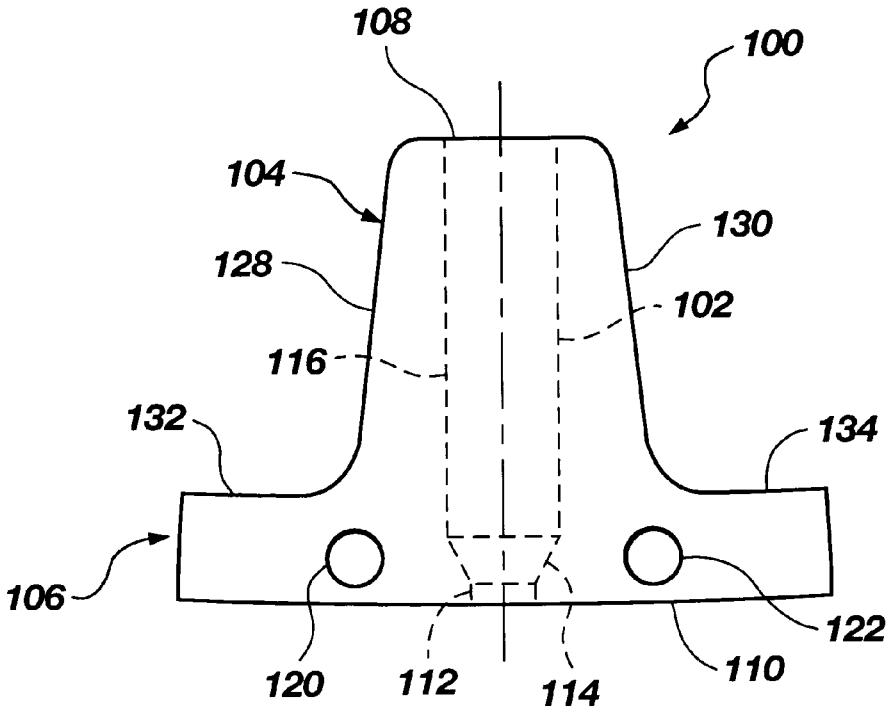
FIGS. 3A and 3B are side and top views, respectively, of a preferred embodiment of a hold down plate in accordance with the principles of the present invention.
Figure 3B:
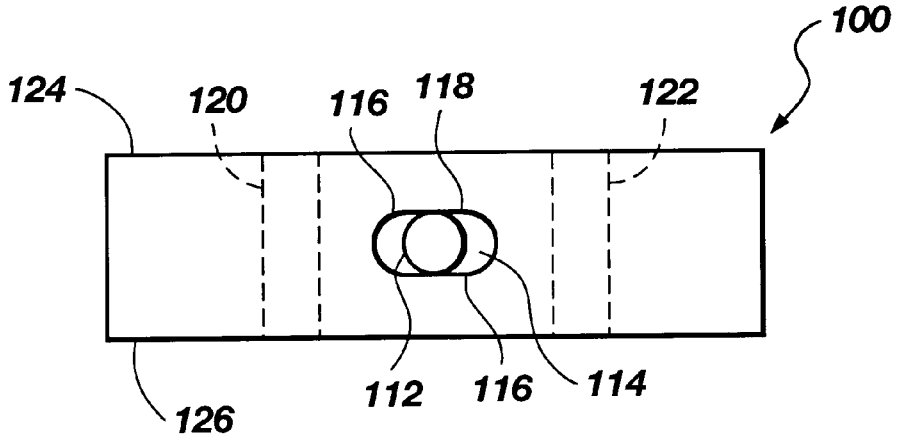

Referring now to FIGS. 3A and 3B, a hold down casting or plate, generally indicated at 100, is illustrated. The hold down plate 100 is similar in many respects to the lamina 42 described above, but may be thicker (in the axial direction) than the normal lamina 42 or end plate 40. It may be preferable to cast the hold down plate 100 as opposed to cutting or milling it from a sheet of steel since there are fewer hold down plates than other laminae in each liner segment and the thickness of the hold down plate may not be conducive to milling or cutting. The hold down plate 100 has a radial hole 102 formed therein extending in the radial direction through the wear portion, generally indicated at 104, and base portion, generally indicated at 106, or from the top surface 108 to the bottom surface 110. The radially extending bore 102 is configured for receiving a liner bolt (not shown), for securing the plate 100 and thus all other laminae attached thereto to the liner (not shown). Those skilled in the art will appreciate upon reviewing the present disclosure that the liner bolt employed with the present invention may be any type of fastener, including for example a rod with external threads on one end and a head on the other, or any configuration since the hold down plate 100 could be configured to accommodate any such liner bolts. The elongate bore 102 is generally comprised of a first portion 112 having a generally circular cross-section, a second frustoconical or transitional section 114 and a third section 116 having an elongate or elliptical cross-section By providing an externally threaded liner bolt with a non-circular head that fits within and abuts against the side walls 116 and 118 of the third section 116, an internally threaded nut can be threaded onto and tightened relative to the liner bolt without causing the liner bolt to rotate relative to the hold down plate 100. Providing a counterbored hole 102 also allows the head of the liner bolt to be disposed inside the bore 102 proximate the base portion 106 such that the head of the bolt will not become worn off during normal use of the lamina. As described above, the radially extending bore 102 extends between a pair of axial bores or holes 120 and 122, and thus the rods, so that the liner bolt and rods operate independently and are thus not intercoupled or otherwise linked.

As further illustrated in FIGS. 3A and 3B, each lamina 100 has a first face or side 124 and a second face or side 126. The sides 124 and 126 are preferably substantially planer and substantially parallel to one another. In addition, the sides 124 and 126 are preferably oriented substantially perpendicular to the axial direction. Thus, when the laminae 100 are combined together to form a liner segment, the side 124 of one lamina abuts against the side 126 of an adjacent lamina. Moreover, as previously described, each of the laminae such as lamina 100 has a base portion 106 and wear portion 104. The base portion 106 may be coupled to the liner or shell of the mill, as shown in FIG. 1, or coupled to another laminae depending on whether or not the laminae is a hold down plate. The wear portion 104 radially extends or protrudes from the base portion 106 section and comprises the portion of the lamina 100 which is employed to contact the ore and thus grind the ore or other material to be ground. The wear portion 104 is defined by top surface 108, and sides 128 and 130. While the shape of the wear portion 104 is generally configured as a gradually tapered protrusion, other configurations of wear sections whether more rounded, more rectangular or having some other geometry, whether symmetrical or asymmetrical, may be employed with the present invention.

The top surfaces 132 and 134 define the top of the base portion 106 and the bottom of the wear portion 106. It would probably not be desirable to wear the lamina 100 beyond the top surfaces 132 and 134. Providing an abrupt transition between the wear portion 104 and the base portion 106, however, helps to reduce the risk of wearing the laminae substantially through the top surfaces 132 and 134. Thus, the base portion 106 is preferably substantially wider than any portion of the wear portion.

Figure 4A:
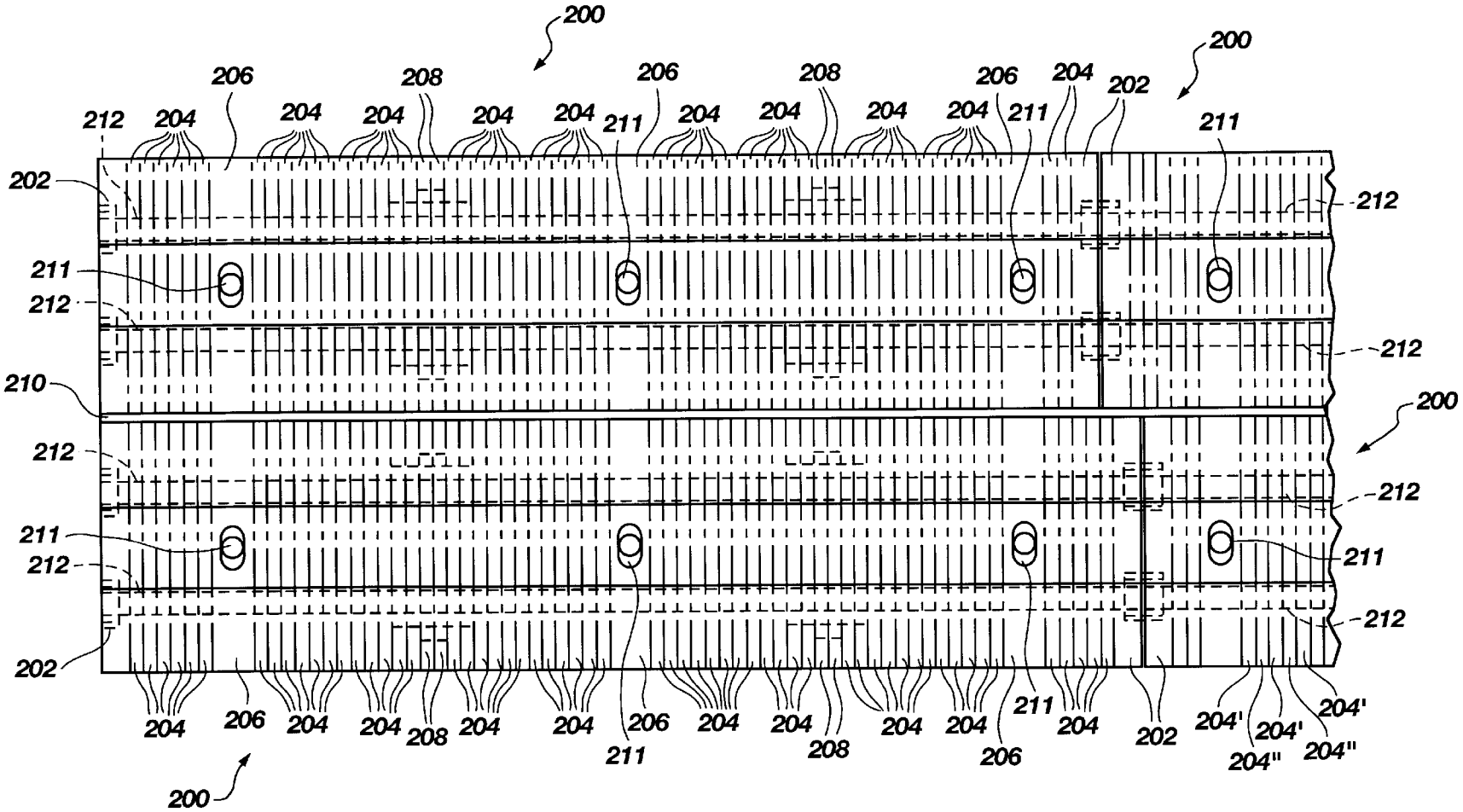
FIGS. 4A and 4B are top and side views, respectively, of a preferred embodiment of a plurality of assembled segments secured to the surface of a mill in accordance with the principles of the present invention.
Figure 4B:
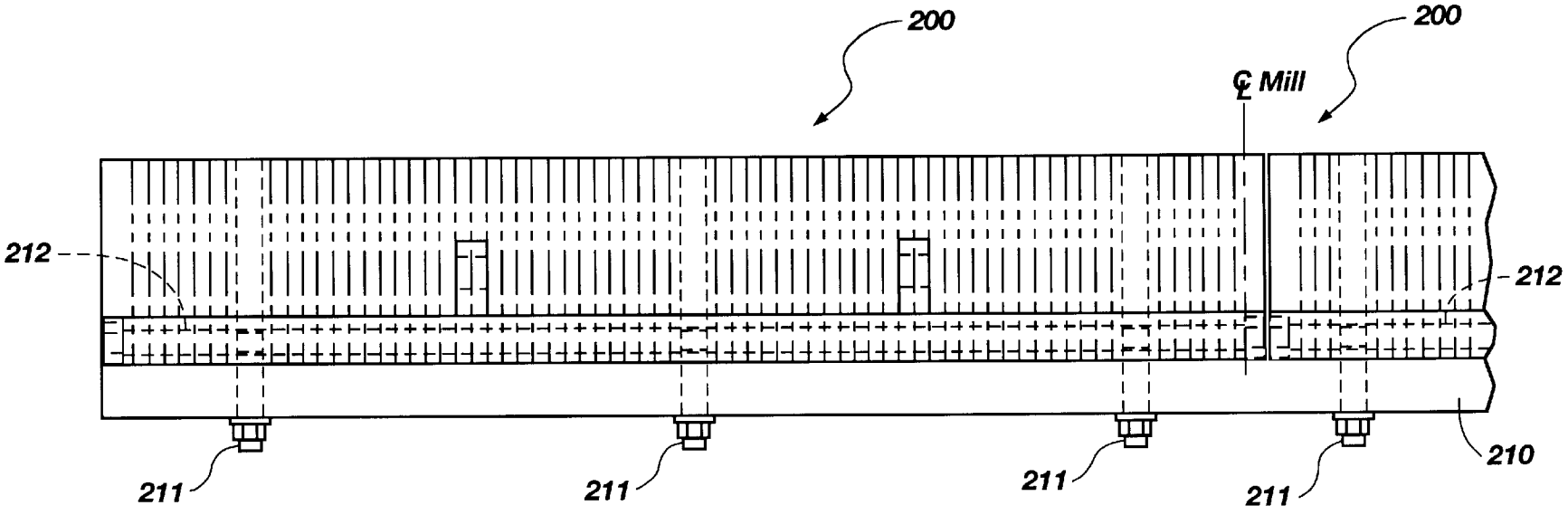

As can be noted by reference to FIGS. 4A and 4B, the liner segments, generally indicated at 200, preferably comprise a plurality of different types of laminae, such as the laminae 40, 42, 44, and 46 shown in FIG. 2. More specifically, it can be noted that the smallest dimension relative to the overall height, width, and thickness of each of the laminae is in the axial direction (i.e., the thickness). Conventionally, because of the desire to maximize the efficiency of the casting process, laminae have been formed with relatively larger thicknesses, so much so that their largest dimension has typically been in the axial direction (i.e., the thickness).

Each liner segment 200 is comprised of a plurality of laminae. The laminae are arrangement in an abutted relationship and include end plates 202, standard plates 204, hold down plates or castings 206 and lift plates 208. While the hold down plates 206 must be positioned to align with their respective holes in the liner 210, the position of the lift plates 208 may be determined by the equipment used to lift the segments 200. In addition, because the standard plates 204 are generally of a smaller thickness than conventional laminae and the number and thickness of such standard plates can be relatively easily varied, the segments 200 can be modified to fit any mill regardless of size or liner bolt 211 spacing.

In a preferred embodiment, the lamina 204 are comprised of various materials, such that, for example, one laminae is comprised of metal, such as martensitic steel or iron, or another hardened material capable of withstanding the rigors of the grinding process and another lamina is comprised of a less expensive and preferably lighter non-martensitic material, such as a hardened rubber, composite, or other suitable metallic or non-metallic material. It is contemplated that in order to decrease the cost of producing the laminae, since pre-hardened steel plates or sheets are more expensive than non-treated steel plates or sheets, some of the laminae may be comprised of less expensive steel or iron that has not been heat treated for hardening. With reference to FIG. 4A, the lamina 204 could comprise hardened steel laminae 204' with softer steel or hardened rubber laminae 204" interposed between the hardened steel laminae 204'. As such, the segment 200 would comprise a composite structure, each laminae 204 forming a layer of the composite segment 200. The laminae 204" thus could be formed with the substantially the same shape as each of the laminae 204' such that each segment 200 has a substantially consistent longitudinal profile. Moreover, because the laminae 204" could be formed from less dense materials that are relatively easy to form, the weight and/or the cost of producing each segment 200 would be substantially decreased. The performance, however, of the segment 200 would not be substantially diminished since the hardened laminae 204' would provide sufficient surface area for the grinding process to be accomplished.

As further illustrated in FIG. 4A, the connecting rods or bolts 212 extend through a plurality of plates to form a segment 200. In addition, because the end plates 202 are provided with recesses or counterbores to house the heads or nuts of the connecting rods 212, liner segments 200 can be abutted in an end-to-end arrangement with little or no gap between adjacent segments 200. Likewise, the width of the base of each of the laminae is configured to provide little or no significant space between adjacent liner segments 200.

Figure 5B:
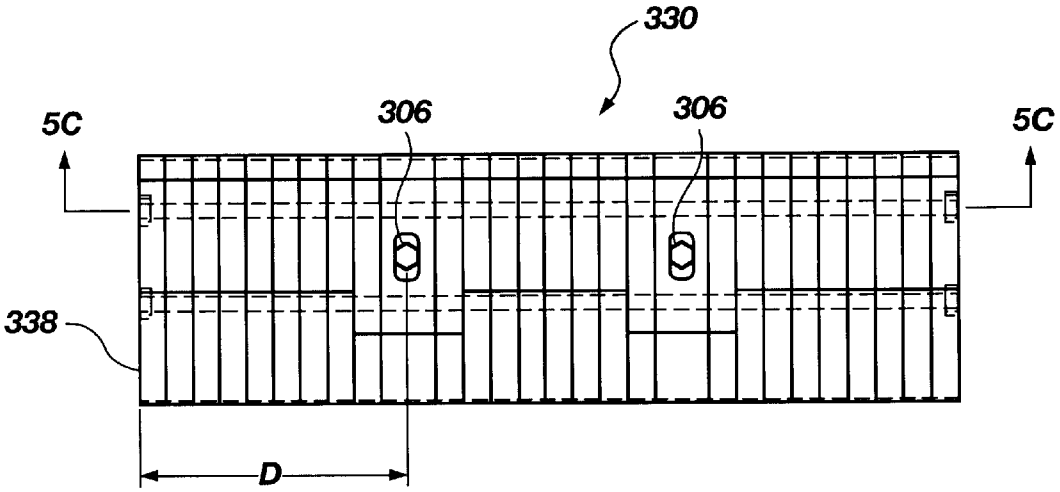
FIGS. 5B and 5C are top and side views, respectively, of the stacked laminae shown in FIG. 5A assembled into a liner segment in accordance with the principles of the present invention.
Figure 5C:
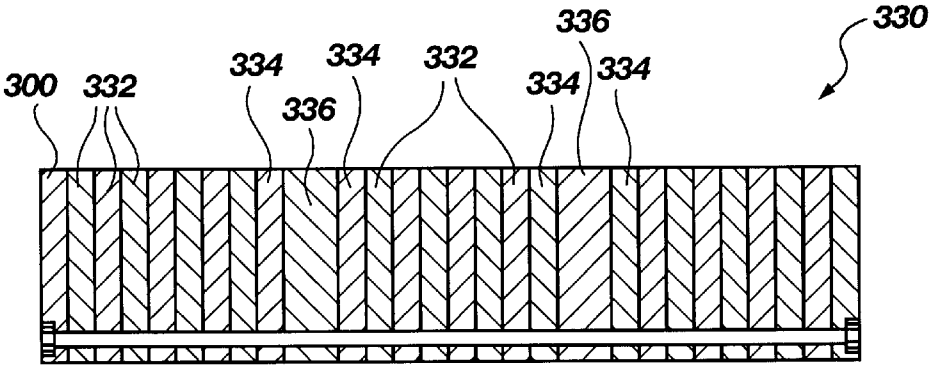
Figure 5A:
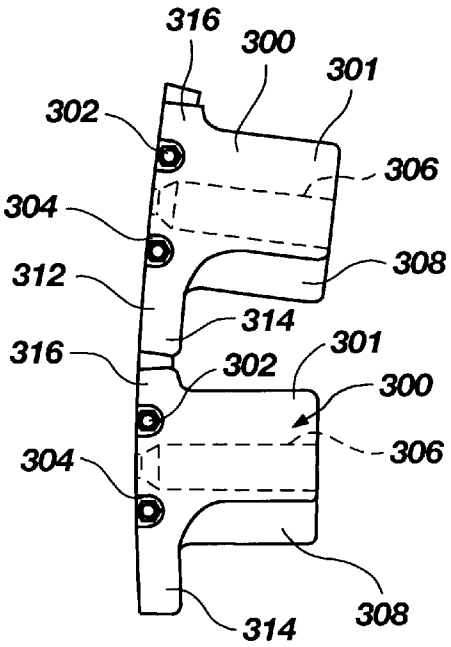
FIG. 5A is side view of a second preferred embodiment of a plurality of stacked laminae in accordance with the principles of the present invention as installed on a shell of a mill.

As shown in FIGS. 5A, 5B, and 5C, various other configurations of laminae may be provided in accordance with the present invention. As shown in FIG. 5A, the lamina comprises an end plate 300 with nut reliefs 302 and 304. The regular or standard plates have a similar configuration but are not provided with nut reliefs 302 and 304. The wear portion 301 of the plate 300 is offset relative to the center line of the elongate bore 306 provided in the hold down plate 308. Thus, the base portion 312 includes a large flange portion 314 and a small flange portion 316. Such a configuration may provide more material at locations in the plate 300 where stresses are highest during the grinding process. That is, because the mill is rotated, moving the wear portion 308 to a location where stresses can be minimized it reduces the risk that the plates will fracture. Of course, since it is desirable to provide the bore 306 for receiving liner bolts with sufficient support structure, it may be desirable to extend the bolt protector or hold down plate 308 beyond the width of the wear portion 301 of the plate 300 and to provide additional bolt protector plates.

As further shown in FIGS. 5B and 5C, the segments 330 may be comprised of end plates 300, regular plates 332, bolt protector plates 334, and bolt carrier castings 336. Moreover, the distance D between the proximal end 338 and the bore 306 may be set as required by the number of plates utilized.

In order to form laminae having substantially uniform microstructures throughout each laminae, the lamina comprising each segment of the mill liner can be individually cut or milled from a plate or sheet of steel or other suitable material having the desired properties such as for example hardness and toughness. As used herein, when a part is said to have "substantially the same" or "substantially uniform" microstructures, it is meant to comprise a generally equivalent grain size and/or microstructure characteristic. When considering the application for which the liners of the present invention are intended, those skilled in the art will recognize that quality control and natural properties and impurities of materials will result in some deviation between core and surface. The same is true as applied to "grain size" or other properties, such as hardness and toughness.

Because of the relative thickness of each of the laminae it is not outside the scope of the present invention to cut, mill or otherwise form the laminae from sheets or plates and then perform heat treating processes as are known in the art to increase the hardness and/or toughness of the laminae. Thus, because of their relatively simple configuration, the laminae of the present invention virtually eliminate the need for casting.

The laminar design of the present invention provides a lamina which may be assembled with other laminae to present virtually any axial length of liner segment. In addition, virtually any cross-sectional shape (perpendicular to the axial direction) may be employed while maintaining control of the microstructure of the laminae during formation. This control is maintained because the laminae are preferably formed from materials having the desired properties such as hardness and toughness and the forming process (e.g., cutting or milling) can be performed without substantially altering the lamina's intrinsic properties. For example, steel plate having a hardness of 500 Brinell or more may be utilized in accordance with the present invention. Such material can be cut as with a torch by various computer controlled equipment known in the art capable of quickly cutting relatively complex configurations without substantially altering the metallurgical properties of the steel.

The laminae of the present invention may therefore be manufactured having a selected microstructure throughout the laminae, which microstructure could not be otherwise achievable by casting and subsequent heat treating. Preferred materials for use in manufacturing the laminae of the present invention include both irons (carbon content greater than approximately 1.25 percent) and steels (carbon content between approximately 0.3 and 0.7 percent). More particularly, high-chromium white irons having a carbon content from approximately 2.5 to approximately 3.0 percent also provide an ideal material from which to manufacture laminae according to the present invention.

As previously discussed, the laminae of the present invention may be made by casting and then heat treating or may be cut from heat treated plates. The laminae are preferably 1 inch thick (axial direction). Because the laminae do not require complex configuration for alignment, they may be cut from plates or sheets of steel or other desirable materials. If the laminae require heat treating, the microstructure may be made essentially equivalent by sizing the axial length of each lamina such that the temperature gradient is more uniform during cooling. The center of the core is that interior location of the lamina which is farthest from all cooling surfaces. The lamina shown in FIG. 1 for example has a core center that is approximately midway along the axial length and essentially equidistant between the top and transition point between the wear portion and the base portion. In selecting conditions conducive to microstructures which are equivalent throughout the liner, an axial dimension which is compared to the transverse and radial dimensions is most advantageous. Thus, the center of the core is closer to planar surfaces of the lamina than it is to the top and bottom surfaces. Generally speaking, the closer the center of the core is to a surface, the more favorable the conditions are for achieving a microstructure which is equivalent throughout the liner. In the present invention, the distance from the center of the core along the axial length of each lamina should be less than the distance from the center of the core to the top or bottom surfaces. Since the laminae of the present invention may be cut from hardened materials, heat treating is typically not required.

After the laminae according to the present invention have been formed, they are then combined with rods to form a liner segment which may be mounted to the shell of a mill with liner bolts. The spacing between liner bolts is primarily a function of the mounting hole pattern in the mill in which the liner segment is being installed. Typical spacing of mounting holes in the shell of the mill ranges from 12 to 24 inches. When the liner segment is assembled, the liner bolts may be placed in the liner segment such that they correspond to the hole pattern in the mill. Thus, the liner segments of the present invention may easily be configured to fit virtually all conventional grinding mills. The laminae may also have different thicknesses to achieve the desired spacing.

When assembling the liner segment, a sufficient number of laminae are "stacked" together to form the desired length liner segment. In one representative example, each lamina is approximately three inches in length. Significantly, the length is less than the radial or transverse dimensions. Thus, to form a 24 inch liner segment, eight laminae must be used. It will be appreciated that liner segments may be assembled having any length which is conventionally known for use in such ore grinding mills. The ability to assemble a variety of lengths of liners represents a significant advantage to liner manufacturers because it eliminates the need to maintain an inventory of each length of liner which might be requested.

When stacking the laminae together, they are placed such that the face of one lamina engages or abuts the face of each adjacent lamina. With the laminae in stacked relation to each other, rods may be inserted through holes in the base section of each lamina. Alternatively, the laminae may be placed on rods in sequence.

When assembling long liner segments, it may be difficult to tighten the nuts on the rods as much as desired. Thus, when assembling long liner segments, it is preferred to heat the rods such that their length will increase due to expansion. In the expanded state, the rods may be placed through the laminae, and the nuts tightened as much as possible. As the rods cool, they will attempt to contract to their original length thereby imparting a significant compressive force on the lamina to secure them together.

When installing a liner segment, a liner handler is used to grasp the liner segment by lifting its lug(s) and holding it up to the shell of the mill in the approximate location where it is desired to mount the liner segment. At this point, conventional liner bolts may then be inserted through the hole in the shell of the mill which corresponds to the liner bolt. A washer and mounting nut may be inserted on the end of the liner bolt. As mounting nut is tightened, it pulls the entire liner bolt toward the exterior of the mill. The liner bolt acts on the laminae, and thus the rods, which transfers this force to the liner segment. Thus, as mounting nut is tightened on liner bolt, each lamina is attached to the liner.

When the liners become worn, removal of the liners may be easily and quickly accomplished. When it is necessary to remove the liners, mounting nuts may be broken loose and removed from each liner bolt. With all of the mounting nuts removed, the liner section may then be broken loose by applying an impact force to conventional liner bolt. The worn liner segment may then be removed through the trunnion of the mill with the assistance of the liner handler. A new liner is then brought into the mill and mounted in its place, following the procedure substantially as described above.

Although the present invention has primarily been described with reference for use with an ore grinding mill, it will be appreciated by one of ordinary skill in the art that the present invention may be used in a variety of applications, including for example a rock impact crusher. From the foregoing, it will be appreciated that the present invention provides methods and apparatus for providing surfaces for use in high impact applications such as in ore comminution. For example, the present invention may be implemented to provide a liner for use in protecting the shell of an ore grinding mill which can be easily and inexpensively attached to and removed from the mill shell or may provide a wear tip on a blow bar. The unique combining apparatus employed by the present invention enable the laminae to be combined and aligned without complex configurations and maximize the wear section and useful life of the liners.

The present invention also provides a liner design which may be cut or otherwise formed from pre-hardened materials such as heat treated steel such that the microstructure of the liner is substantially uniform throughout. In addition, because the laminae of the present invention can be produced with sufficient hardness and toughness without requiring heat treatment, the present invention effectively reduces the risk that the laminae which comprise the liner segment will crack during any such heat treating process. Thus, the liners of the present invention have substantially the same degree of hardness and toughness throughout the liner and the amount of hardness and toughness may be preselected prior to forming the laminae.

Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A liner segment for use as an impact surface in comminution equipment, comprising:

a plurality of laminae configured for being associated together to form an integral segment, each of said plurality of laminae having a base portion and a wear portion having a transverse width that is substantially smaller than a width of said base portion, each of said plurality of laminae having a pair of spaced-apart axial holes formed in said base portion;

a plurality of hold down plates, each having a pair of axial holes and a radial hole formed therein, said pair of spaced-apart axial holes configured for aligning with said pair of axial holes formed in said plurality of laminae and said radial hole configured for receiving a liner bolt for securing the hold down plates to the comminution equipment; and a pair of elongate members disposed in and extending through said pair of axial holes of each of said plurality of laminae and said plurality of hold down plates for combining and aligning the plurality of laminae and the plurality of hold down plates together to form an integral segment.

2. The liner segment of claim 1, further including end plates, and lifter plates.

3. The liner segment of claim 2, wherein said plurality of laminae comprise laminae of different thicknesses in an axial direction.

4. The liner segment of claim 2, wherein each of said end plates define a pair of axial bores extending through said end plate and a recess formed proximate to each of said pair of axial bores for providing a nut relief, said plurality of elongate members extending through said pair of axial bores.

5. The liner segment of claim 2, wherein each of said lifter plates define at least one lifting portion integrally formed therein defining at least one aperture configured for lifting and maneuvering the integral segment.

6. The liner segment of claim 2, further including at least one bolt protector plate abutted against said hold down plate, said at least one bolt protector plate and said hold down plate having a wear portion that is substantially wider in the transverse direction than the wear portion of said plurality of laminae.

7. The liner segment of claim 1, wherein said plurality of laminae are each formed from martensitic steel plates such that each of said plurlaity of laminae have a substantially uniform martensitic microstructure throughout.

8. The liner segment of claim 1, wherein at least some of said plurality of laminae are comprised of a non-martensitic steel material.

9. The liner segment of claim 8, wherein said non-martensitic steel laminae are interposed between laminae comprised of a material selected from the group comprising iron, hardened steel and alloys of each.

10. The liner segment of claim 8, wherein said plurality of laminae comprise an elongate composite liner segment in which laminae comprised of non-martensitic steel material are interposed between laminae comprised of martensitic steel.

11. The liner segment of claim 10, wherein said non-martensitic steel material is comprised of rubber and said martensitic steel is a hardened steel alloy.

12. The liner segment of claim 1, wherein said wear portion is offset in a transverse direction relative to said base portion of at least some of said plurality of laminae.

13. The liner segment of claim 1, wherein said pair of elongate members extend substantially the entire length of the segment.

14. The liner segment of claim 1, wherein each lamina is comprised of metal plate having a core and a surface, and wherein each metal plate has been heat treated for hardness prior to being formed into said lamina such that the core microstructure of said lamina is substantially equivalent to the surface microstructure of said lamina.

15. An liner segment for use as an impact surface on the shell of a grinding mill, comprising:

a plurality of laminae configured for being associated together along an axial direction to form an integral segment, each lamina formed from pre-hardened steel plate having generally parallel opposite sides perpendicular to the axial direction, a base portion and a wear portion, the base portion having a pair of spaced-apart holes extending through said base portion in the axial direction;

a plurality of hold down plates, each having a pair of spaced-apart axial holes and a radial hole disposed between said pair of spaced-apart axial holes, said pair of spaced-apart axial holes configured for aligning with said pair of spaced-apart holes formed in said plurality of laminae and said radial hole configured for receiving a liner bolt for securing the plurality hold down plates and thus the liner segment to the shell of a grinding mill; and a pair of elongate rods disposed in the pair of spaced-apart holes of said plurality of laminae and in the pair of spaced-apart axial holes in said plurality of hold down plates, said pair of elongate rods extending substantially the entire length of the segment for combining the plurality of laminae and the plurality of hold down plates to form an integral segment and for limiting relative movement of the plurality of laminae; and a plurality of liner bolts inserted through said radial holes of each of said hold down plates for attaching the liner segment to the grinding mill.

16. The liner segment of claim 15, wherein said plurality of laminae have a substantially smaller axial dimension than said plurality of hold down plates.

17. The liner segment of claim 15, wherein the wear portion of each of said plurality of laminae is offset in a transverse direction relative to said base portion.

18. The liner segment of claim 15, wherein the plurality of liner bolts comprise conventional liner bolts and said radially extending bore is configured to receive said conventional liner bolts for securing said liner segment to said shell of the grinding mill.

19. The liner segment of claim 15, further including end plates, and lifter plates.

20. The liner segment of claim 19, wherein said lifter plates comprise at least one integral lug for lifting said liner segment.

21. The liner segment of claim 15, wherein some of said plurality of laminae are comprised of pre-hardened steel plates.

22. The liner segment of claim 21, wherein some of said plurality of laminae are comprised of rubber.

23. The liner segment of claim 22, wherein said rubber laminae and said steel laminae form a composite liner segment having said rubber laminae interposed between said pre-hardened steel laminae.

24. A liner segment for use as an impact surface in comminution equipment, comprising:

a plurality of laminae configured for being associated together along an axial direction to form an elongated integral segment, each lamina having generally planer parallel opposite sides perpendicular to the axial direction configured for abutting sides of adjacent lamina, a base portion configured for being abutted against the comminution equipment, and a wear portion protruding from the base portion, the base portion having a pair of axial holes extending therethrough;

a plurality of hold down plates, each having a pair of spaced-apart axial holes and a radial hole disposed between said pair of spaced-apart axial holes, said pair of spaced-apart axial holes configured for aligning with said pair of axial holes formed in said plurality of laminae and said radial hole configured for receiving a liner bolt for securing the plurality hold down plates and thus the liner segment to the shell of a grinding mill; and a pair of elongate rods disposed in the pair of axial holes and extending substantially the length of the plurality of laminae and the plurality of hold down plates for combining the plurality of laminae to form an integral segment and for substantially limiting relative movement of the laminae and hold down plates, at least one end of each of said pair of elongate rods having an externally threaded end;

a plurality of internally threaded nuts, each threaded onto said at least one end of said pair of elongate rods for securing said pair of elongate rods relative to said plurality of laminae, said pair of elongate rods and said plurality of internally threaded nuts holding and aligning said plurality of laminae in an abutting relationship; and a plurality of liner bolts for securing said hold down plates to the comminution equipment and thus attaching the integral segment to the comminution equipment.

25. The laminar segment of claim 24, wherein said plurality of laminae are formed from pre-hardened martensitic steel plates.

26. The laminar segment of claim 24, wherein at least one lamina disposed at an end of the segment defines recesses formed therein about the axial holes for receiving nuts configured for threading onto the ends of said pair of rods.

27. The laminar segment of claim 24, wherein at least one lamina has a lug extending therefrom and an aperture extending through the lug to enable lifting of the segment.

28. The laminar segment of claim 24, wherein at least some of said plurality of lamina are comprised of a non-metallic material.

29. The laminar segment of claim 26, wherein said wear portion has a substantially smaller transverse dimension that said base portion.

* * * * *